US008015623B2

(12) United States Patent
Lee et al.

(10) Patent No.: US 8,015,623 B2
(45) Date of Patent: Sep. 13, 2011

(54) BELT EXTENDER

(75) Inventors: George E. Lee, Prescott, AZ (US); Erik Philip Ericksen, Ennis, MT (US)

(73) Assignee: High Valley Ranch Properties, L.L.C., Ennis, MT (US)

( * ) Notice: Subject to any disclaimer, the term of this patent is extended or adjusted under 35 U.S.C. 154(b) by 315 days.

(21) Appl. No.: 12/405,981

(22) Filed: Mar. 17, 2009

(65) Prior Publication Data

US 2010/0235968 A1 Sep. 23, 2010

(51) Int. Cl.
*A41F 3/02* (2006.01)

(52) U.S. Cl. ..... 2/338; 2/311; 2/312

(58) Field of Classification Search ..... 2/338, 311, 2/312, 318, 319, 321, 322; 224/197, 163; 24/163 R, 165, 265 R, 265 BC
See application file for complete search history.

(56) References Cited

U.S. PATENT DOCUMENTS

| | | | | |
|---|---|---|---|---|
| 1,622,954 | A | 3/1927 | Macheroux | |
| 1,803,214 | A * | 4/1931 | Siegel | 24/698.3 |
| 2,159,857 | A * | 5/1939 | Mix | 2/301 |
| 2,916,742 | A | 12/1959 | Sobel | |
| 3,017,641 | A | 1/1962 | Stollman | |
| 3,828,370 | A | 8/1974 | Ihmels | |
| 4,281,440 | A | 8/1981 | Britz | |
| 5,575,011 | A | 11/1996 | Allen | |
| 5,604,958 | A * | 2/1997 | Anscher | 24/3.1 |
| 5,826,280 | A | 10/1998 | Bradley | |
| 5,970,526 | A | 10/1999 | Weathers | |
| 6,108,821 | A | 8/2000 | Malsoute | |
| 6,671,888 | B2 | 1/2004 | Wallace | |
| 6,842,912 | B1 | 1/2005 | King et al. | |
| 2003/0074720 | A1 * | 4/2003 | Reed | 2/322 |

* cited by examiner

*Primary Examiner* — Gary L Welch
*Assistant Examiner* — Andrew W Collins
(74) *Attorney, Agent, or Firm* — Antoinette M. Tease

(57) ABSTRACT

A belt extender for installation on a belt with a removable buckle comprising a main body with a first end and a second end, a metal tab fixedly attached to and extending from a first end of the main body of the belt extender, and a longitudinal slot roughly centrally disposed on the main body of the belt extender. The main body folds over itself at a fold line that extends through the center of the longitudinal slot and is secured in place with snap fasteners to create a folded end. A belt buckle comprising a tongue and a frame is installed on the folded end of the belt extender by sliding the frame of the belt buckle over the second end of the belt extender and inserting the tongue through the longitudinal slot prior to folding. The metal tab is inserted into a longitudinal slot on the buckle end of the belt strap and rotated so that the main body of the belt extender is aligned with the belt strap on the buckle end of the belt.

8 Claims, 3 Drawing Sheets

BELT EXTENDER

BACKGROUND OF THE INVENTION

1. Field of the Invention

The present invention relates generally to the field of belts, and more specifically, to a belt extender.

2. Description of the Related Art

There are a number of inventions designed to provide a belt that is adjustable to accommodate an increase in girth of the wearer, either temporarily or permanently. None of these inventions, however, is designed so that it can be used to retrofit an existing belt. Examples are discussed below.

U.S. Pat. No. 1,622,954 (Macheroux, 1927) provides a belt with a box-like structure comprising two where the buckle would normally be. The box-like structure comprises two parts that telescope, one into the other, and that house a spiral spring and metal cable. The metal cable is attached to the spring via a hook, thereby forming a retractor. The retractor allows the belt to expand under tension while at the same time limiting the degree of extension. This invention is limited in that it only allows for temporary expansion and cannot be used to retrofit existing belts.

U.S. Pat. No. 2,867,023 (Putnam, 1959) discloses a belt buckle in which spring or magnet mechanisms allow the belt buckle itself to expand when tension is placed on the belt. The buckle comprises front and back pieces, which are connected through the spring, allowing them to spread apart as tension is added. This invention is limited in that it only allows for temporary expansion and cannot be used to retrofit existing belts.

U.S. Pat. No. 2,916,742 (Sobel, 1959) involves an adjustable belt with alternating male and female fastener elements arranged in alignment and medially along the buckle end of the belt. The fastener elements are set at equal distances from each other so that when the buckle end of the belt is inserted through a buckle and folded back on itself, a female fastener lines up with a male fastener, thereby allowing the length of the belt to be set. This invention is limited in that it cannot be used to retrofit existing belts.

U.S. Pat. No. 3,017,641 (Stollman, 1962) describes a belt in which the size of the belt can be adjusted by inserting or removing a "keeper strap." The buckle itself is fitted with a receiving post. The keeper strap is attached to the belt buckle via the receiving post. The keeper strap comprises a retaining loop, and the buckle attachment end of the belt is inserted through the retaining loop of the keeper strap and also secured to the belt buckle via the receiving post. This invention is limited in that it can only be used with a buckle that is fitted with a receiving post and cannot be used to retrofit existing belts.

U.S. Pat. No. 3,828,370 (Ihmels, 1974) provides a band adjustment device for garments with overlapping parts separated from each other in the wait or hip region. The invention comprises a belt with two ends; one end of the belt has perforated holes for engaging the tongue (or spike) of the belt buckle, and the other end of the belt comprises a strip with a longitudinal slot. The strip is attached to the belt buckle by a device that is attached to the belt buckle and that comprises a clamping roller that engages the strip. The slot in the strip is engaged by a button-like roller-shaped limiting member. In this manner, the belt can be adjusted on both ends—by setting the tongue of the belt buckle in one of the perforated holes on one end of the belt strap and by moving the limiting member within the slot on the other end of the belt strap and securing the same with the clamping roller. This invention is limited in that it cannot be used to retrofit existing belts.

U.S. Pat. No. 5,575,011 (Allen, 1996) discloses a detachable waist band extender that allows an individual to wear a garment with a particular waist band dimension when the waist measurement of the individual exceeds the waist dimension of the garment. The garment must have a fly opening extending downward from an upper edge of a waist band of the garment, and it must also have a button on one side of the fly opening and a button hole on a second side of the fly opening. One end of the waist band extender is secured to the button on one side of the fly opening, and the other end of the waist band extender is inserted through the button hole on the other side of the fly opening. This invention is limited in that it can only used with garments with a particular fly opening configuration and also because it cannot be used to retrofit existing belts.

U.S. Pat. No. 5,826,280 (Bradley, 1998) involves a belt with a removable buckle and latch. The belt body has a tongue end with a plurality of openings and a buckle end with two longitudinally spaced slots, as well as fastening snaps. The belt buckle can be moved from one slot to the other, thereby increasing or decreasing the functional length of the belt. This invention is limited in that it cannot be used to retrofit existing belts.

U.S. Pat. No. 5,970,526 (Weathers, 1999) describes an adjustable multi-part belt with a male buckle and a female buckle that engage with one another. The belt further comprises an elongated central portion with looped bands and a layer of hook-and-loop fastener material for engaging first and second side portions of the belt. The length of the belt is adjusted by adjusting the positioning of the hook-and-loop layer of the central portion relative to the hook-and-loop layers of the first and second side portions of the belt. This invention is limited in that it cannot be used to retrofit existing belts.

U.S. Pat. No. 6,108,821 (Malsoute, 2000) provides a trouser belt with an extensible clasp. To extend the length of the belt, the wearer presses on two tappets that protrude laterally from the clasping part of the belt so as to disengage ratchets from serrations and free the sliding plate and buckle. When the elastic portion has expanded to a point at which the wearer is comfortable, he simply releases the tappets, thereby bringing the ratchets back to bear on the serrations by a rappelling spring. This invention is limited in that it cannot be used to retrofit existing belts.

U.S. Pat. No. 6,711,788 (Chen, 2004) discloses a belt system with an extendable connection between the belt and the buckle. One end of the belt is attached to a plate that sits behind the buckle. This plate is attached to the buckle with springs that extend from the plate to the buckle so that when a force is placed on the belt, the springs unwind, and the belt expands. This invention is limited in that it only provides for temporary expansion and cannot be used to retrofit existing belts.

U.S. Pat. No. 6,842,912 (King et al., 2005) involves an expandable trouser belt comprising a strap with two substantially non-elastic portions and a short elastic portion located between the two non-elastic portions. The belt further comprises a keeper adjacent to the buckle for holding one end of the belt to the other, and the elastic portion of the strap is located directly beneath the keeper. This invention is limited in that it only provides for temporary expansion and cannot be used to retrofit existing belts.

Two other inventions worth noting relate to an interchangeable belt buckle and a belt configuration system designed to assist disabled persons. Although neither of these inventions solves the same problem as the present invention, namely, accommodation of an increase in girth of the wearer, they are worth noting because they relate to belt and/or belt buckle innovations.

U.S. Pat. No. 4,281,440 (Britz, 1981) describes a belt buckle constructed to receive a removable flexible belt loop. The belt buckle comprises a frame with raised sides on two opposite edges that protect a material covering wrapped around the buckle frame and extending between the two opposite edges of the buckle frame. The belt buckle further comprises a hinge element that engages a flanged locking member with a claw grabbing surface for securing a belt strap end against the material covering.

U.S. Pat. No. 6,671,888 (Wallace, 2004) provides a multi-segment belt system for use with a conventional pair of pants. The purpose of this invention is to provide a belt that can be used by disabled persons. The belt system comprises (i) a docking/loop strap with snap members that snap around the belt loop, (ii) a cinching or pulling strap with a slot at one end and a pull ring at the other, (iii) a loop element with a loop that allows a portion of the cinching strap to slide through it and a means (such as a hook-and-loop fastener) for linking the loop element along the inside surface of a waist band; and (iv) a closure member with a button on one side and a contact binding surface on an opposite side for mating with a contact binding surface on the cinching strap. When fully assembled, this belt system allows the wearer use the belt system by simply pulling on the ring of the cinching strap or a ring on the end of the closure member.

What is missing from the inventions described above is one that allows the owner of a belt to retrofit the belt with an extension piece that works with conventional belts and that allows the length of the belt to be permanently (but removably) increased. Accordingly, it is an object of the present invention to provide a belt extender that can be used to retrofit existing belts to increase the length of the belt for as long as the extender is installed on the belt. It is a further object of the present invention to provide a belt extender that can be removed to decrease the length of the belt to its original length, if desired.

BRIEF SUMMARY OF THE INVENTION

The present invention is a belt extender for installation on a belt with a removable buckle comprising a main body with a first end and a second end; a metal tab fixedly attached to and extending from a first end of the main body of the belt extender; and a longitudinal slot roughly centrally disposed on the main body of the belt extender; wherein the main body folds over itself at a fold line that extends through the center of the longitudinal slot and is secured in place with snap fasteners to create a folded end; wherein a belt buckle comprising a tongue and a frame is installed on the folded end of the belt extender by sliding the frame of the belt buckle over the second end of the belt extender and inserting the tongue through the longitudinal slot prior to folding; and wherein the belt comprises a belt strap with a buckle end, and the metal tab is inserted into a longitudinal slot on the buckle end of the belt strap and rotated so that the main body of the belt extender is aligned with the belt strap on the buckle end of the belt.

In a preferred embodiment, the belt comprises a belt strap with a thickness and color, wherein the main body of the belt extender has a thickness and color, and wherein the main body of the belt extender has the same thickness and color as the belt strap. Preferably, the metal tab comprises a front face and a central portion, and the main body of the belt extender comprises an extension that covers the front face of the central portion of the metal tab when the belt extender is installed on a belt. In an alternate embodiment, the metal tab comprises a front face, and the main body of the belt extender comprises an extension that covers the entire front face of the metal tab.

In a preferred embodiment, the metal tab comprises a first lateral member, a second lateral member, and a central connector; the central connector connects the first lateral member to the second lateral member; and the belt comprises a belt strap with a buckle end, and the second lateral member is inserted into a longitudinal slot on the buckle end of the belt strap and rotated so that the main body of the belt extender is aligned with the belt strap on the buckle end of the belt. Preferably, the first lateral member, the second lateral member, and the central connector of the metal tab are comprised of a single piece of metal.

In a preferred embodiment, the main body of the belt extender is comprised of a single piece of leather. In a first embodiment, the metal tab comprises a first lateral member, a second lateral member, and a central connector; the central connector connects the first lateral member to the second lateral member; and the metal tab is attached to the first end of the main body by inserting the first lateral member through a distal slot in the first end of the main body and folding the first end of the main body over the first lateral member of the metal tab to create a fold line that extends through the distal slot, thereby causing the central connector to extend through the distal slot and the second lateral member to extend outward from the fold line that extends through the distal slot. In a second embodiment, the metal tab is attached to the first end of the main body with an adhesive.

REFERENCE NUMBERS

Figure 1:
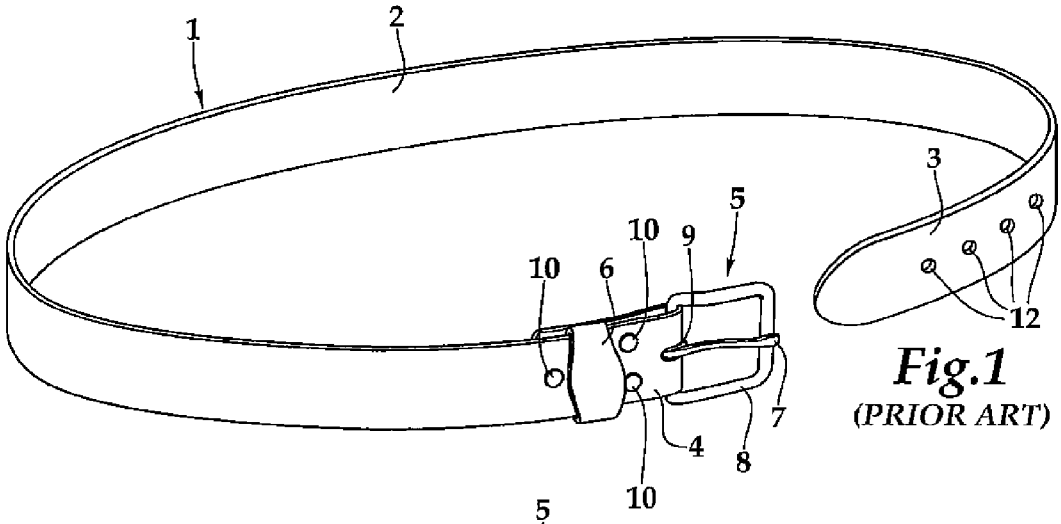
Fig.1 (PRIOR ART)
FIG. 1 is a perspective view of a prior art belt.

1 Belt
2 Belt strap
3 Tongue end (of belt strap)

4 Buckle end (of belt strap)
5 Belt buckle
6 Retaining piece
7 Tongue (of buckle)
8 Frame (of buckle)
9 Longitudinal slot (in buckle end of belt strap)
10 Male portion of snap fastener (on buckle end of belt)
11 Female portion of snap fastener (on buckle end of belt)
12 Perforated holes (in tongue end of belt strap)
13 Belt extender
14 Main body
15 Longitudinal slot (in main body of belt extender)
16 Male portion of snap fastener (on belt extender)
17 Female portion of snap fastener (on belt extender)
18 Rivet
19 Distal slot (for metal tab in belt extender)
20 First fold line (on belt extender)
21 Extension (of main body of belt extender)
22 Second fold line (on belt extender)
23 First lateral member (of metal tab)
24 Second lateral member (of metal tab)
25 Central connector (of metal tab)
26 Central portion (of metal tab)
27 Metal tab (of belt extender)

DETAILED DESCRIPTION OF INVENTION

FIG. 1 is a perspective view of a prior art belt in which the belt buckle itself is interchangeable. The belt 1 comprises a strap 2 with a tongue end 3 and a buckle end 4. The belt 1 further comprises a buckle 5 and a retaining piece 6. The buckle 5 comprises a tongue 7 and a frame 8. In a typical belt arrangement, the buckle end 4 of the belt 1 is inserted through the frame 8 of the buckle 5 and the tongue 7 inserted through a longitudinal slot 9 in the buckle end 4 of the belt strap 2. The buckle end 4 comprises snap fasteners 10 that secure the folded-over buckle end 4 to itself. The retaining piece 6 is preferably situated between the snap fasteners 10 on the buckle end 4 of the belt 1 and is used to secure the tongue end 3 of the belt strap 2 once it has been inserted through the buckle 5 and the tongue 7 has been inserted into one of the perforated holes 12 in the tongue end 3 of the belt strap 2, as is known in the art.

Figure 2:
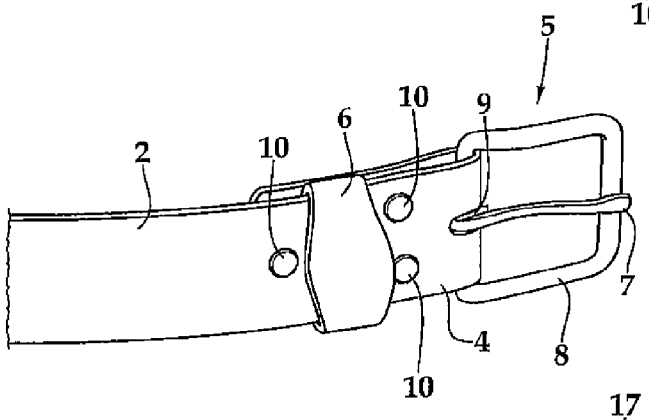
Fig.2 (PRIOR ART)
FIG. 2 is a detail perspective view of the belt buckle portion of a prior art belt.

FIG. 2 is a detail perspective view of the belt buckle portion of a prior art belt. This figure shows the belt buckle end 4 of the belt strap 2, the buckle 5, the buckle frame 8 and tongue 7, the retaining piece 6, and the snap fasteners 10. (In a preferred embodiment, the snap fasteners comprise male and female portions 10, 11; only the male portions of the snap fasteners are shown in FIGS. 1 and 2.) To change the belt buckle, the buckle end 4 is unsnapped from itself at the snap fasteners 10, the belt buckle end 4 is unfolded, the tongue 7 of the belt buckle 4 is removed from the slot 9, and the frame 8 is slid off of the buckle end 4 of the belt strap 2. At this point, a different belt buckle may be installed, and/or the belt extender of the present invention may be installed.

Other than the one-piece belt extender, no additional parts or tools are needed to install or use the belt extender, and it is not necessary to have a specially manufactured belt or belt buckle. As shown below, the belt buckle of the present invention was designed to be used with existing belts with removable buckles.

Figure 3:
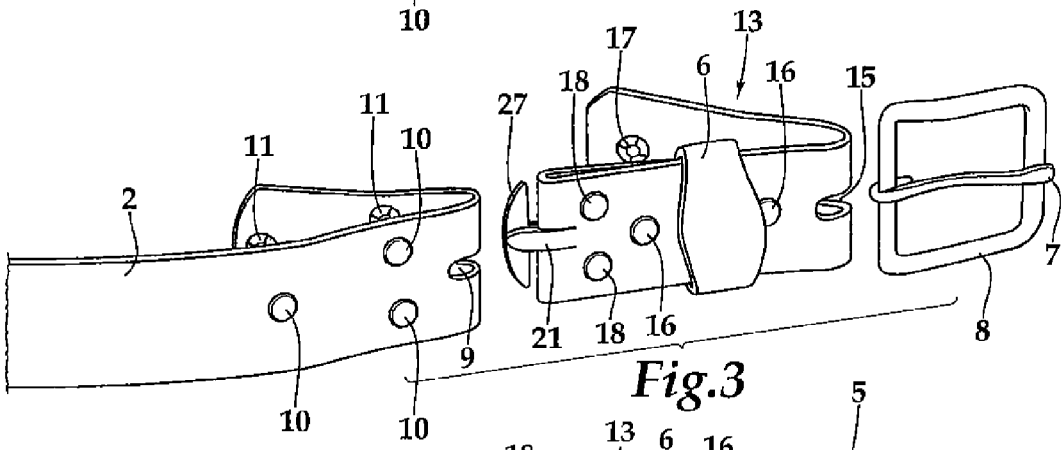
FIG. 3 is a detail perspective view of the belt extender of the present invention with the belt buckle detached from the belt buckle portion of the prior art belt.

FIG. 3 is a detail perspective view of the belt extender of the present invention with the belt buckle detached from the belt buckle portion of the prior art belt. In this figure, the belt buckle 5 has been removed from the buckle end 4 of the belt strap 2, as described above. The belt extender 13 comprises a main body 14, which is preferably comprised of a single piece of leather, with a longitudinal slot 15 roughly centrally disposed in the main body 14. In a preferred embodiment, the main body 14 is the same color and thickness as the belt strap 2. The belt extender 13 further comprises snap fasteners 16 that allow the belt extender 13 to be folded over onto itself and secured; the snap fasteners 16 preferably comprises male 16 and female 17 portions. The retaining piece 6 from the belt 1 is preferably situated between the snap fasteners 16, as shown in FIG. 3.

A metal tab 27 extends from one end of the belt extender 13 through a distal slot 19 (not shown) on one end of the belt extender 13. To secure the metal tab 27 in place, one end of the main body 14 is folded over onto itself such that the first fold line 20 extends through the center of the distal slot 19, as shown more clearly in FIG. 6. The folded-over end of the main body 14 is preferably secured in place with rivets 18, thereby securing the metal tab 27 on the end of the belt extender 13. The present invention is not limited to any particular method of attaching or securing the metal tab 27 to the end of the belt extender 13, however. The method described above is but one of several methods that could be used to secure the metal tab 27 to the end of the belt extender 13. In a preferred embodiment, the main body 14 comprises an extension 21 that lies over the central portion of the metal tab 27 (on the front face of the metal tab 27) so that the metal tab 27 is not visible from the front of the belt 1 when the belt extender 13 is installed (see FIG. 4).

Figure 4:
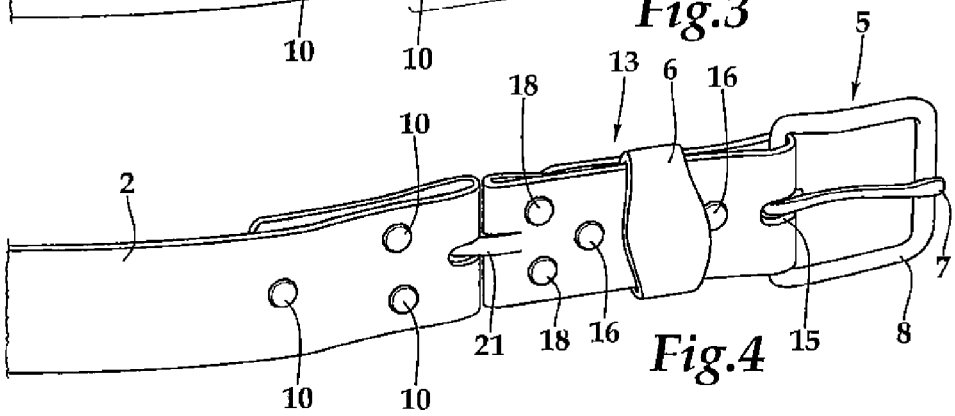
FIG. 4 is a detail perspective view of the belt extender of the present invention installed on a prior art belt.
Figure 4A:
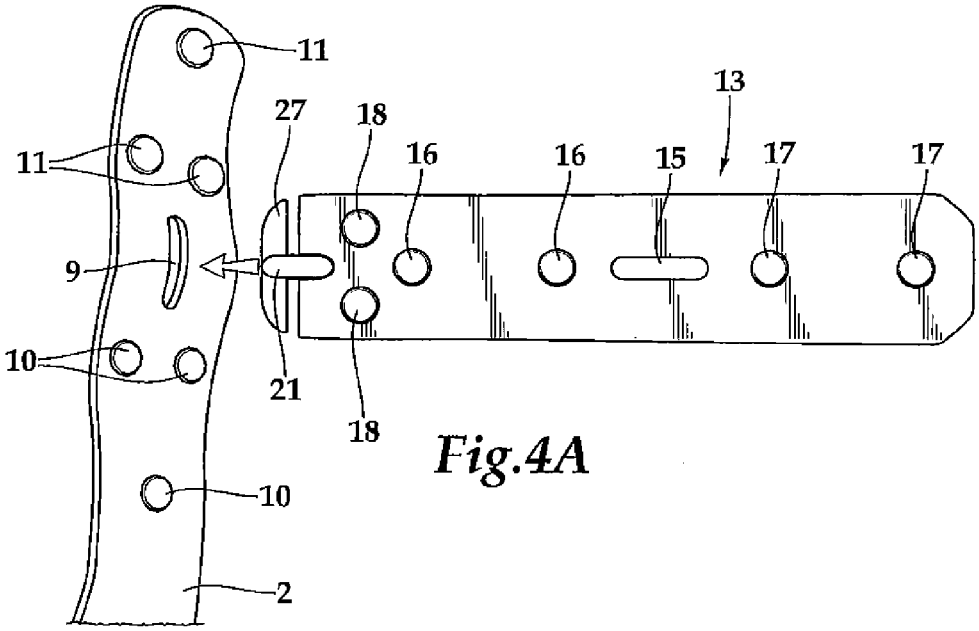
FIG. 4A is a detail perspective view of the metal tab of the belt extender in relation to the longitudinal slot on the buckle end of the belt strap prior to insertion of the metal tab into the longitudinal slot.

To install the belt extender 13 on the belt 1, the metal tab 27 is inserted into the longitudinal slot 9 in the buckle end 4 of the belt 1 (see FIG. 4A) and then rotated so that the main body 14 of the belt extender 13 is aligned with the buckle end 4 of the belt strap 2, as shown in FIG. 4. The retaining piece 6 is slid onto the opposite end of the belt extender 13 from the metal tab 27 and preferably situated between the snap fasteners 16. Next, the buckle frame 8 is slid onto the opposite end of the belt extender 13 from the metal tab 27, and the buckle tongue 7 is inserted into the longitudinal slot 15 in the belt extender 13. The main body 14 is then folded over onto itself at a second fold line 22 (see FIG. 5) that extends through the center of the longitudinal slot 15, and the snap fasteners 16, 17 are fastened, thereby securing the belt buckle 5 and retaining piece 6.

FIG. 4 is a detail perspective view of the belt extender of the present invention installed on a prior art belt. It is anticipated by the inventors that the belt extender 13 will come in different lengths. Because it is preferably comprised of a single piece of material, a single metal tab, two snap fasteners and two optional rivets, the belt extender 13 is very easy to manufacture. In addition, a single belt extender 13 may be used with multiple belts.

Figure 5:
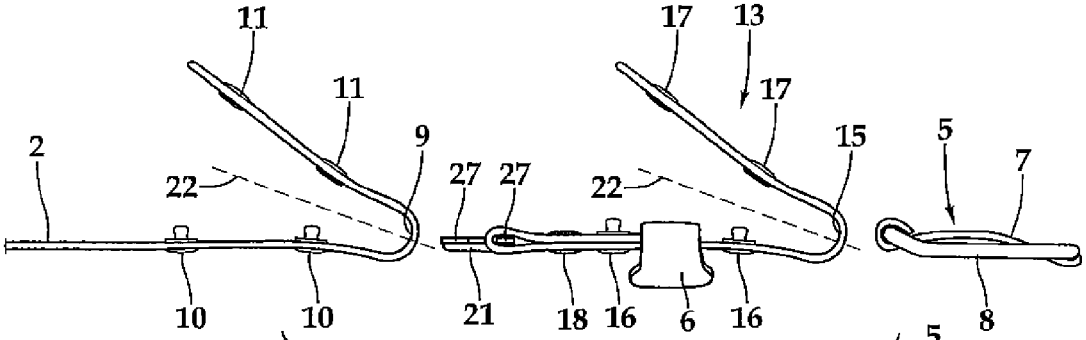
FIG. 5 is a top view of the belt extender of the present invention with the belt buckle detached from the belt buckle portion of the prior art belt.

FIG. 5 is a top view of the belt extender of the present invention with the belt buckle detached from the belt buckle portion of the prior art belt. This view is the same view shown in FIG. 3, except from the top. This view shows the second fold line 22 described in connection with FIG. 3 above.

Figure 6:
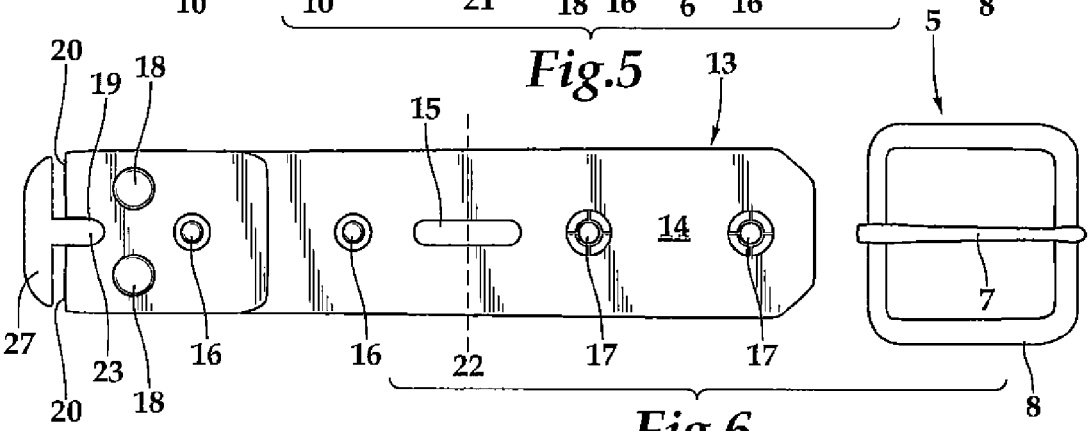
FIG. 6 is a rear view of the belt extender of the present invention shown in relation to the belt buckle.

FIG. 6 is a rear view of the belt extender of the present invention shown in relation to the belt buckle. This figure shows the first and second fold lines 20, 22 and the distal slot 19 through which the metal tab 27 is inserted. In this view, the belt extender 13 is unfolded (that is, it is not folded at the second fold line 22).

Figure 7:
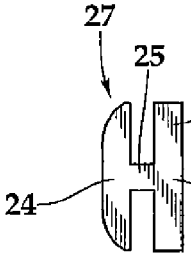
FIG. 7 is a side plan view of the metal tab of the belt extender.
Figure 8:
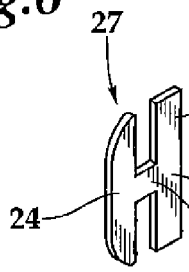
FIG. 8 is a perspective view of the metal tab of the belt extender.

FIG. 7 is a side plan view of the metal tab of the belt extender, and FIG. 8 is a perspective view of the metal tab of the belt extender. In a preferred embodiment, the metal tab 27 is a single piece of metal comprising a first lateral member 23, a second lateral member 24, and a central connector 25. The central connector 25 connects the first lateral member 23 to the second lateral member 24. The first lateral member 23 is the part of the metal tab 27 that lies on the inside of one end of the belt extender 13 when that end is folded over onto itself and secured with rivets 18 (see FIG. 6). The second lateral member 24 is the part of the metal tab 27 that is inserted into the longitudinal slot 9 in the buckle end 4 of the belt strap 2 to attach the belt extender 13 to the belt (see FIG. 4A). The central portion 26 of the metal tab 27 includes the central connector 25 and central portions of the first lateral member 23 and second lateral member 24. The central portion 26 of the metal tab is the part that is covered by the extension 21 on the main body 14 of the belt extender 13 (see FIG. 4).

Figure 9:
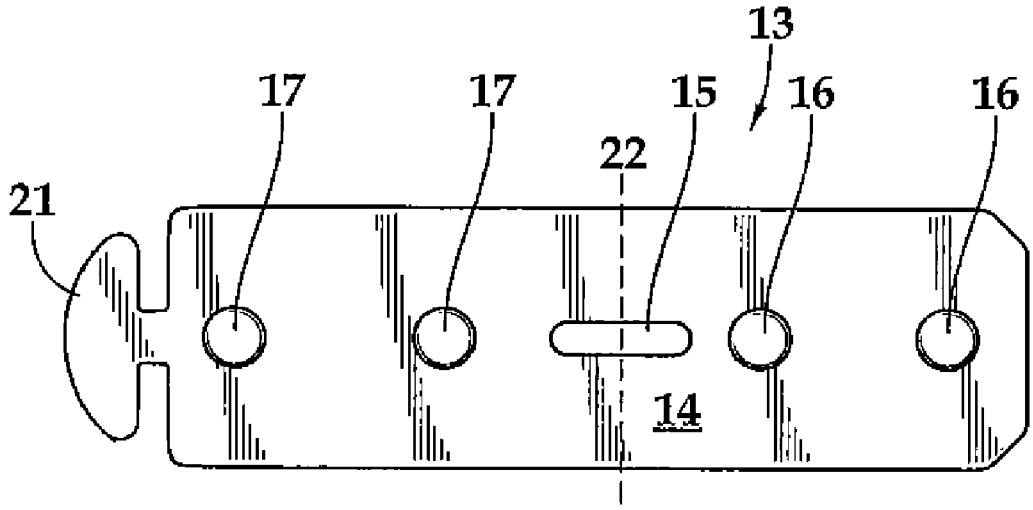
FIG. 9 is a front view of an alternate embodiment of the belt extender in which the leather piece fully covers the metal tab.
Figure 10:
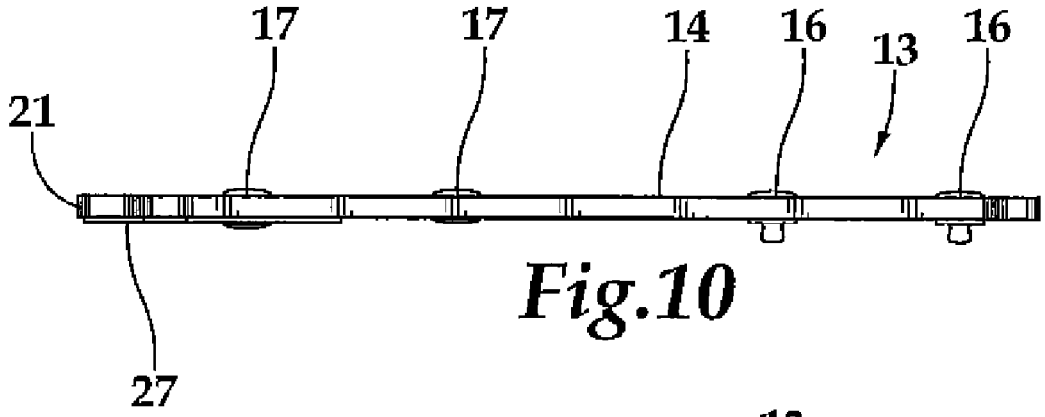
FIG. 10 is a side view of an alternate embodiment of the belt extender in which the leather piece fully covers the metal tab.
Figure 11:
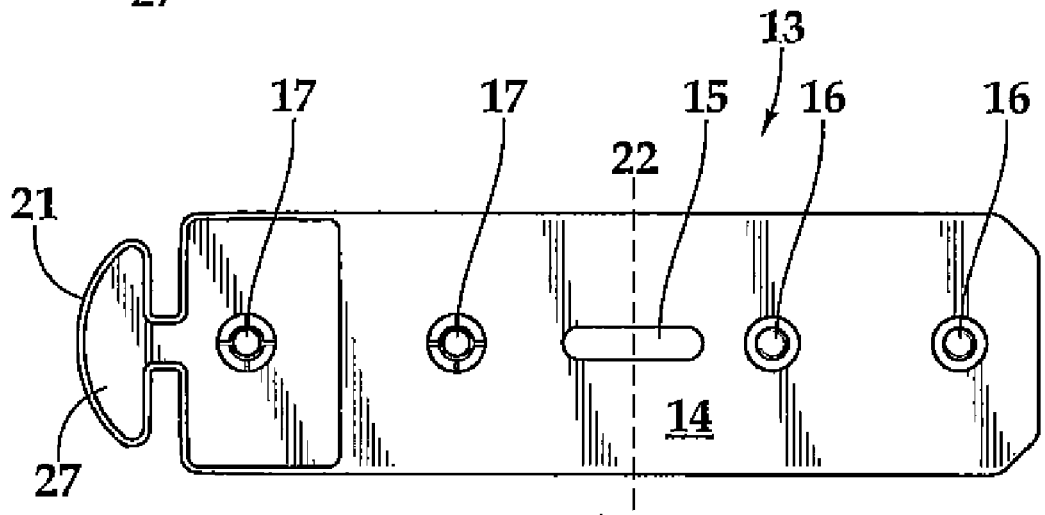
FIG. 11 is a rear view of an alternate embodiment of the belt extender in which the leather piece fully covers the metal tab.

FIGS. 9-11 show an alternate embodiment of the belt extender in which the extension 21 of the main body 14 covers the entire front face of the metal tab 27 and not just the central portion 26 of the metal tab 27. In addition, in this embodiment, the metal tab 27 is glued onto the main body 14 of the belt extender 13 rather than being secured with rivets, as shown and discussed in connection with FIGS. 3 and 6; thus, there is no first fold line 20. A careful reader will also note that the orientation of the male and female fasteners in relation to the metal tab 27 is different than in previous figures; that is, in this figure, the female portions 17 of the snap fasteners are situated closer to the metal tab 27 than the male portions 16, whereas in FIG. 6, the male portions 16 of the snap fasteners are situated closer to the metal tab 27 than the female portions 17. The present invention is not limited to any particular number or configuration of snap fasteners.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A belt extender for installation on a belt having a removable buckle and an overall length comprising:

(a) a main body with a first end and a second end;

(b) a metal tab comprising a first lateral member and a second lateral member, wherein the metal tab is fixedly attached to and extending from a first end of the main body of the belt extender, and wherein the first lateral member of the metal tab lies on the inside of the first end of the main body of the belt extender when the first end of the main body of the belt extender is folded over onto itself and secured with rivets adjacent to the first lateral member; and (c) a longitudinal slot roughly centrally disposed on the main body of the belt extender;

wherein the main body folds over itself at a fold line that extends through the center of the longitudinal slot and is secured in place with snap fasteners to create a folded end;

wherein a belt buckle comprising a tongue and a frame is installed on the folded end of the belt extender by sliding the frame of the belt buckle over the second end of the belt extender and inserting the tongue through the longitudinal slot prior to folding;

wherein the belt comprises a belt strap with a buckle end, and the metal tab is inserted into a longitudinal slot on the buckle end of the belt strap and rotated so that the main body of the belt extender is aligned with the belt strap on the buckle end of the belt;

wherein the belt comprises a retaining piece, and wherein the retaining piece is situated on the belt extender between the snap fasteners; and wherein the belt extender extends the overall length of the belt.

2. The belt extender of claim 1, wherein the belt comprises a belt strap with a thickness and color, wherein the main body of the belt extender has a thickness and color, and wherein the main body of the belt extender has the same thickness and color as the belt strap.

3. The belt extender of claim 1, wherein the metal tab comprises a front face and a central portion, and wherein the main body of the belt extender comprises an extension that covers the front face of the central portion of the metal tab when the belt extender is installed on a belt.

4. The belt extender of claim 1, wherein the metal tab comprises a front face, and wherein the main body of the belt extender comprises an extension that covers the entire front face of the metal tab.

5. The belt extender of claim 1, wherein the metal tab comprises a first lateral member, a second lateral member, and a central connector;

wherein the central connector connects the first lateral member to the second lateral member; and wherein the belt comprises a belt strap with a buckle end, and the second lateral member is inserted into a longitudinal slot on the buckle end of the belt strap and rotated so that the main body of the belt extender is aligned with the belt strap on the buckle end of the belt.

6. The belt extender of claim 5, wherein the first lateral member, the second lateral member, and the central connector of the metal tab are comprised of a single piece of metal.

7. The belt extender of claim 1, wherein the main body of the belt extender is comprised of a single piece of leather.

8. The belt extender of claim 1, wherein the metal tab comprises a first lateral member, a second lateral member, and a central connector;

wherein the central connector connects the first lateral member to the second lateral member; and wherein the metal tab is attached to the first end of the main body by inserting the first lateral member through a distal slot in the first end of the main body and folding the first end of the main body over the first lateral member of the metal tab to create a fold line that extends through the distal slot, thereby causing the central connector to extend through the distal slot and the second lateral member to extend outward from the fold line that extends through the distal slot.

* * * * *